United States Patent [19]

Kobayashi

[11] 4,270,742

[45] Jun. 2, 1981

[54] PAPER STACK BINDING AND FOLDING DEVICE

[76] Inventor: Hiroshi Kobayashi, No. 35-22, 3-chome, Shimorenjaku, Mitaka-City, Tokyo, Japan

[21] Appl. No.: 955,195

[22] Filed: Oct. 27, 1978

[30] Foreign Application Priority Data

Mar. 27, 1978 [JP] Japan ..... 53/35156
Mar. 28, 1978 [JP] Japan ..... 53/34974

[51] Int. Cl.[3] ..... B41L 43/12
[52] U.S. Cl. ..... 270/37; 270/53
[58] Field of Search ..... 270/37, 53, 67, 80–85; 227/50

[56] References Cited

U.S. PATENT DOCUMENTS

| | | | |
|---|---|---|---|
| 1,676,156 | 7/1928 | Rader | 270/37 |
| 1,937,979 | 12/1933 | Reynolds | 270/37 |
| 3,265,274 | 8/1966 | Burnell | 227/50 |
| 3,554,531 | 1/1971 | Heigl | 270/53 |

FOREIGN PATENT DOCUMENTS

| | | |
|---|---|---|
| 29-9208 | 8/1954 | Japan . |
| 48-29731 | 9/1973 | Japan . |
| 51-11448 | 3/1976 | Japan . |

*Primary Examiner*—Edgar S. Burr
*Assistant Examiner*—A. Heinz
*Attorney, Agent, or Firm*—Oblon, Fisher, Spivak, McClelland & Maier

[57] ABSTRACT

A paper stack binding and folding device which comprises an inclined machine frame, a paper stack feed table at one end of said machine frame having a movable abutment ruler and a slit and slots therein, a paper stack feed mechanism having a paper stack feed pawl for extending through said slit to feed a paper stack, a stapling mechanism positioned below said paper stack and having stapler guns for ejecting staples to said paper stack and a caulking member for bending said staples, binding position control stops for stopping the feed of said paper stack in a predetermined binding position, a paper stack folding mechanism having a pair of parallel folding rolls defining a gap therebetween to fold the paper stack and a folding position control stop for stopping the feed of the bound paper stack in a predetermined folding position.

5 Claims, 6 Drawing Figures

PAPER STACK BINDING AND FOLDING DEVICE

BACKGROUND OF THE INVENTION

This invention relates to a paper stack binding and folding device which can bind a paper stack including a number of sheets of paper at one edge or in the center of the stack and also fold the paper stack in the bound center as desired or necessary.

In the conventional book binding processes, a paper stack including a plurality of sheets or paper is bound and folded in the center of the stack or the paper stack is bound at one edge thereof.

The above-mentioned conventional book binding processes employ a binding machine and a folding machine which are positioned at separate areas in a book binding facility for performing binding and folding operations at different times or a binding machine and a folding machine positioned at one area in a book binding facility for performing binding and folding operations in a continuous manner whereby the conventional book binding processes require a relatively large floor space for installing the two types of machines and a large scale operation facility resulting in increase in book binding cost and inefficient operation efficiency.

SUMMARY OF THE INVENTION

Therefore, one principal object of the present invention is to provide a paper stack binding and folding device which eliminates the use of two types of machines such as a paper stack binding machine and a paper stack folding machine as required in the conventional book binding processes and which can concurrently perform paper stack binding and folding operations in a continuous manner.

Another object of the present invention is to provide a paper stack binding and folding device which is especially suitable for binding and folding a paper stack including a relatively small number of sheets of paper to make a simple booklet comprising a relatively small number of copies of documents obtained by a copy press provided in a business facility.

A further object of the present invention is to provide a paper stack binding and folding device which can bind a paper stack at one edge or in the center of the stack and fold the paper stack in the bound center as desired.

A still further object of the present invention is to provide a paper stack binding and folding device which requires a relatively small floor space for installing the device.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

The present invention will be now described referring to the accompanying drawings in which one preferred embodiment of the paper stack binding and folding device of the invention is shown for illustration purpose only, but not for limiting the scope of the same in any way.

Figure 1:
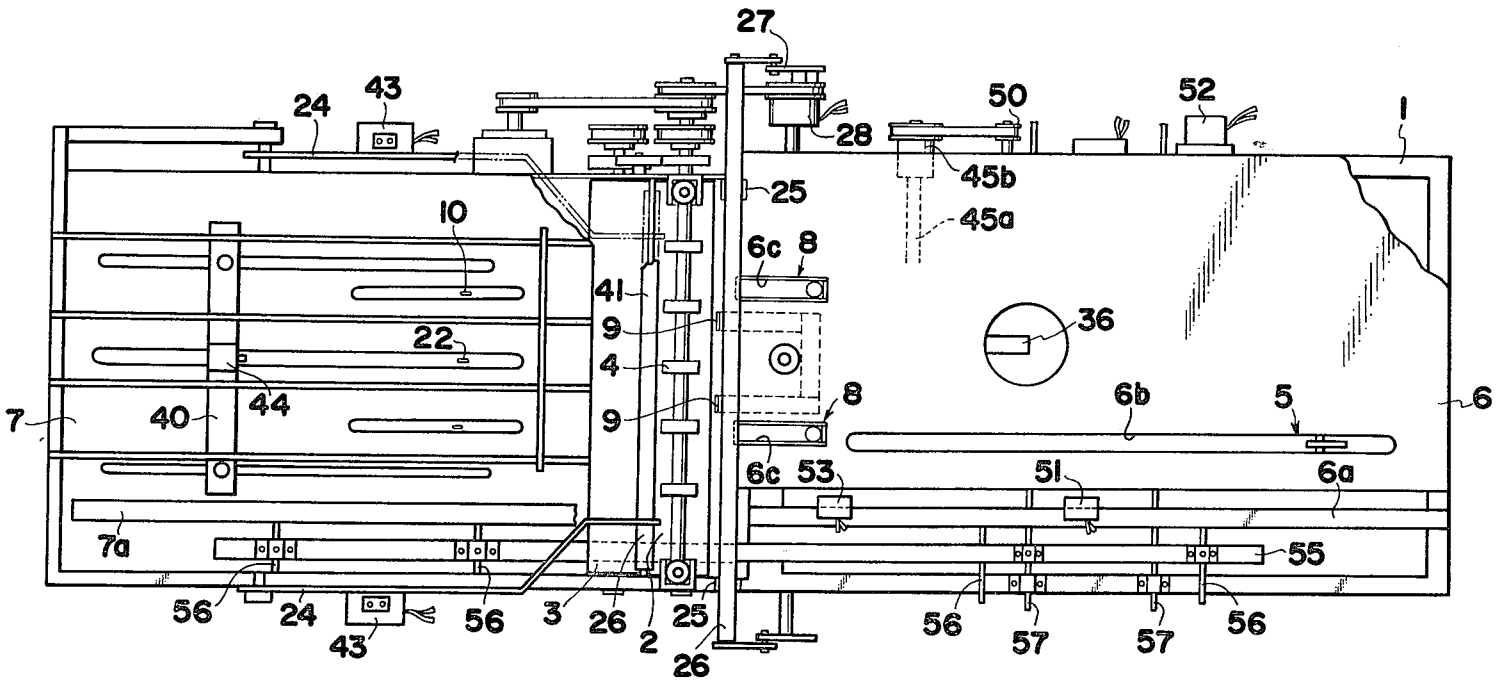
FIG. 1 is a front elevational view of one embodiment of the paper stack binding and folding device of the present invention with a portion thereof broken away.

The paper stack binding and folding device generally comprises a rectangular machine frame generally shown by reference numeral 1 and disposed at the angle of about 75° with respect to the horizon with the upper side edge positioned rearwardly of the lower side edge or away from the plane of FIG. 1. A pair of paper stack folding rolls 2 and 3 are fixedly mounted on their associated parallel transverse shafts which are in turn rotatably supported on the machine frame 1 substantially in the center of the machine frame. The rolls 2, 3 are spaced from each other to define a gap therebetween for receiving and folding a paper stack and driven in the opposite directions to each other. The shaft on which the roll 3 is mounted is movable toward and away from the shaft on which the roll 2 is mounted so that the width of the gap defined between the rolls can be adjusted to accommodate paper stacks having different thicknesses.

A plurality of spaced feed rolls 4 are mounted on a transverse shaft which is in turn rotatably supported on the machine frame 1 above the shaft on which the roll 2 is mounted. The shaft associated with the feed rolls 4 is movable toward and away from the shaft associated with the roll 2 and driven in the opposite direction to the direction in which the shaft associated with the roll 2 is rotated. The feed rolls 4 define a gap in cooperation with the underlying roll 2 for lightly gripping and feeding a paper stack A in the manner as will be described hereinafter. The width of the gap defined between the rolls 2, 4 is also adjustable since the shaft associated with the rolls 4 is movable toward and away from the shaft associated with the roll 2.

Provided on one side or the right-hand side of the feed roll mechanism including the rolls 2, 3 and 4 and their associated shafts (FIG. 1) on the machine frame 1 is a feed table 6 having a paper stack feed mechanism 5 and provided on the other side or the left-hand side of the feed roll mechanism (FIG. 1) on the machine frame 1 is a paper stack stop position control table 7. The feed table 6 and paper stop position control table 7 comprise vertically adjustable paper abutment rulers 6*a*, 7*a* adjacent to the lower side edges thereof, respectively and the rulers 6*a*, 7*a* extend horizontally along the length of the associated feed table and paper stop position control table, respectively. The paper stack A to be bound is laid on the feed table 6 with the lower edge of the paper stack in abutment against the ruler 6*a* and passed through the gap defined between the rolls 2, 4 to and onto the paper stack stop position control table 7.

The paper stack feed table 6 is provided with a pair of parallel and spaced slots 6c, 6c adjacent to the end of the feed table in proximity to the rolls 2, 4 and stapler guns 8, 8 are positioned below the slots 6c in the feed table 6 so as to bind the paper stack A in a predetermined position thereof when the area of the paper stack A to be bound is positioned over the stapler guns 8 and the feed of the paper stack is momentarily stopped.

The means for momentarily stop the feed of the paper stack A on the feed table 6 comprises stops 9 adjacent to the inner end of the paper stock feed table 6 and stops 10 on the paper stack stop position control table 7, respectively.

The stops 9 and 10 are selectively employed, that is, when the paper stack A is to be bound at one edge, the stops 9 are employed whereas when the paper stack is to be bound in the center, the stops 10 are employed.

The stops 9 are positioned adjacent to the inner end of the paper stack feed table 6 nearer to the feed rolls 2, 4 rather than to the tops of the stapler guns 8 by a predetermined distance and adapted to project upwardly from the upper surface of the table 6 when the stops 9 are employed. The stop 9 extends upwardly from the leading or inner end of a rocking lever 11 (FIG. 2) suitably pivoted to the undersurface of the paper stack feed table 6. The rocking lever 11 is normally urged in the direction to project the stop 9 upwardly of the upper surface of the feed table 6 by means of a spring 12 and retracts the stop 9 to a position below the upper surface of the feed table 6 when a solenoid 9a associated with the lever 11 is energized. A switch actuation piece 13 is mounted on the rocking lever 11 for movement together with the stop 9 as the latter projects upwardly of the upper surface of the feed table 6 and retracts from the projecting position to the retracted position below the surface of the feed table. The switch actuation piece 13 is adapted to be actuated when the leading edge of the paper stack A abuts against the switch actuation piece 13 whereby a limit switch 14 positioned below the feed table 6 is turned on. When the limit switch 40 is turned on, a signal is produced from the limit switch to actuate a binding mechanism in the manner as will be described hereinafter.

Furthermore, the rocking lever 11 is adapted to be held in the retracted position by means of the operation shaft 15a of a shift switch 15 which is adapted to shift the operation shaft between the electrical system associated with the above-mentioned stops 9 and that associated with the above-mentioned stops 10 as will be described hereinafter. When the rocking lever 11 is released from the retracted position or the electric system associated with the stops 9 is turned on, a solenoid 17 for actuating a paper stack guide piece 16 is turned conductive. The paper stack guide piece 16 is adapted to directly feed the paper stack A from the feed table 6 into the gap defined between the rolls 2, 3 and more particularly, when the solenoid 17 is turned conductive, the paper stack guide piece 16 is rocked downwardly towards the rolls 2, 3 to push the paper stack A into the gap between the rolls 2, 3.

The stops 10 are vertically movable through the slots formed in the paper stack stop position control table 7 between the advanced or extended position in which the stops project above the upper surface of the control table and the retracted position in which the stops are disposed below the undersurface of the control table and the stops are also movable back and forth within the slots. For the purpose, the stops 10 are secured at one end to a common arm 21 which is pivoted at the other end to a frame 19 by means of a pin 20. The frame 19 is slidable on a rail 18 which is in turn secured to the undersurface of the paper stack stop position control table 7 and extends in the longitudinal direction of the control table 7. The one end of the arm 21 also supports a limit switch 22 and as the arm 21 is pivoted in the clockwise direction (as seen in FIG. 1) about the pin 20, the stops 10 and limit switch 22 project above the upper surface of the adjustment mechanism 7.

The arm 21 is normally urged in the clockwise direction by means of a spring 23 so as to project the stops 10 and limit switch 22 and pivoted in the counter-clockwise direction as a solenoid 24 secured to the frame 19 is turned conductive or energized whereupon the stops 10 and limit switch 22 are retracted into the position below the control table 7.

The paper stack A is momentarily stopped in its movement when the stops 9 or stops 10 engage the leading edge of the paper stack A and bound by the stapling mechanism including the stapler guns 8. As more clearly shown in FIG. 3, the stapling mechanism comprises a pair of parallel and spaced guide frames 25, a presser rod 26 received between the guide frames for slidable movement along the frames and having a link 26a having one end pivoted thereto, a crank 27 having the other end of the link pivoted thereto for imparting one reciprocal movement to the presser rod 26, an electromagnetic clutch 28 for imparting one complete rotation to the crank 27, and a staple caulking member 29 adapted to be urged against the stapler gun 8 by the presser rod 26 as the latter moves in the staple feed direction. In binding the paper stack A, with the portion of the paper stack A to be bound positioned in the binding position on the paper stack feed table 6, the staple pusher 30 is actuated to push the leading one of staples 8a out of the stapler gun 8 to cause the staple to pierce through the paper stack A and the staple caulking member 29 is urged against the stapler gun 8 to caulk the staple against the paper stack A to thereby bind the paper stack A.

Figure 3:
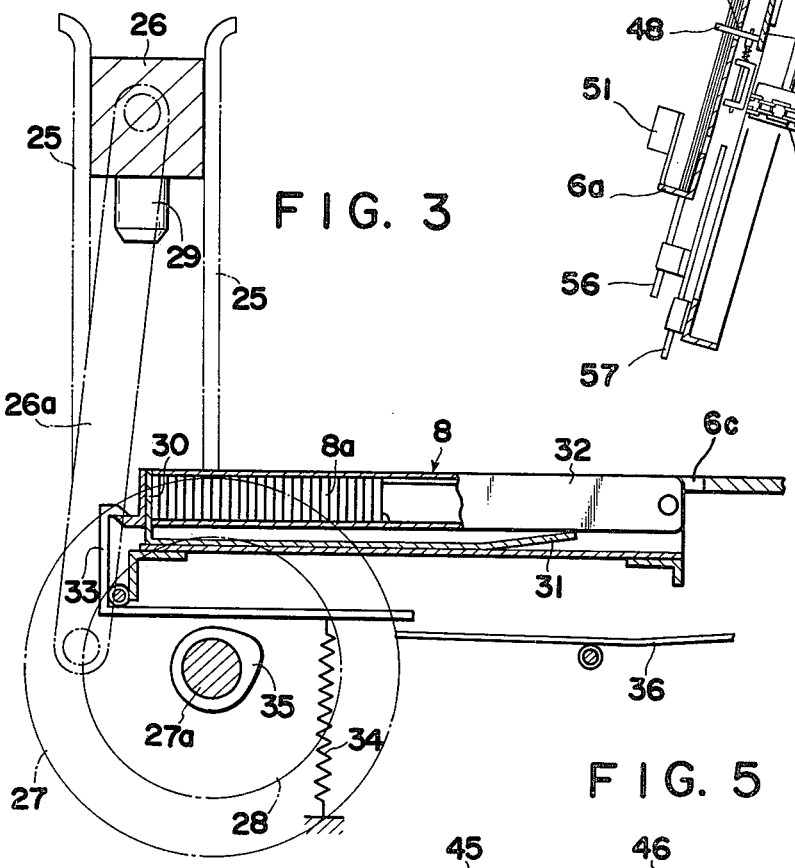
FIG. 3 is a fragmentary cross-sectional view on a further enlarged scale of the paper stack binding mechanism of said paper stack binding and folding device of FIG. 1.
Figure 5:
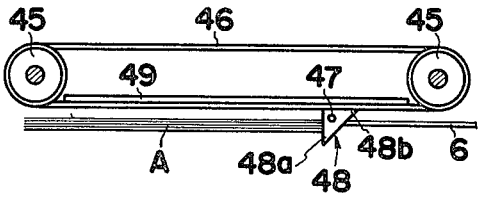
FIG. 5 is a cross-sectional view of a portion of the paper stack feed mechanism of FIG. 4 showing the portion in the horizontal position.
Figure 6:
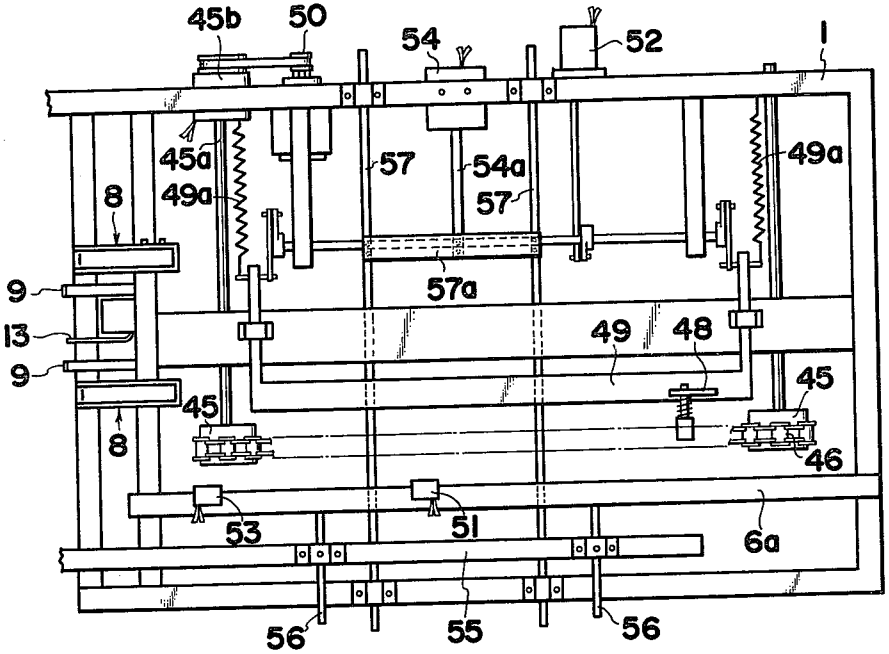
FIG. 6 is a fragmentary front elevational view of the right-hand portion of FIG. 1 with the cover removed therefrom.

In FIG. 3, reference numeral 31 denotes is a leaf spring adapted to urge the staple case 32 of the stapler gun 8 upwardly for binding operation, reference numeral 33 denotes a hook adapted to hold the staple case 32 downwardly against the force of the leaf spring 31, reference numeral 34 denotes a spring adapted to urge the hook 33 downwardly, reference numeral 35 denotes a cam secured to the shaft 27a of a crank 27 and adapted to cause the hook 33 to urge the staple case 32 upwardly and reference numeral 36 denotes a manual lever.

The electromagnetic clutch 28 associated with the stapling mechanism for one complete rotation is driven by a signal current from the limit switch 14 associated with the stops 9 or the limit switch 22 associated with the stops 10.

The above-mentioned crank shaft 27a has a limit switch operation cam 37 secured thereto and the cam 37 is adapted to operate a limit switch 38 during the return movement of the presser rod 26 as the crank 27 rotates.

When the limit switch 38 is operated, the limit switch provides an operation signal to the solenoid 9a or solenoid 24 to thereby retract the stops 9 or stops 10 from the extended position. The solenoids 9a and 24 having holding circuits (not shown) connected thereto.

The holding circuits are adapted to be deenergized in response to a release signal from a release switch 39 positioned below the feed rolls 2, 3 and adapted to operate in response to the feed of the paper stack A.

The paper stack stop position control table 7 further comprises a stop 40 downstream of the stops 10 in the feed direction of the bound paper stack A for controlling the folding position of the bound paper stack A and the stop 40 is adapted to stop the feed of the paper stack A when the bound paper stack has reached a predetermined folding position on the rolls 2, 3 after the paper stack binding operation by the binding mechanism as mentioned hereinabove has completed.

Figure 2:
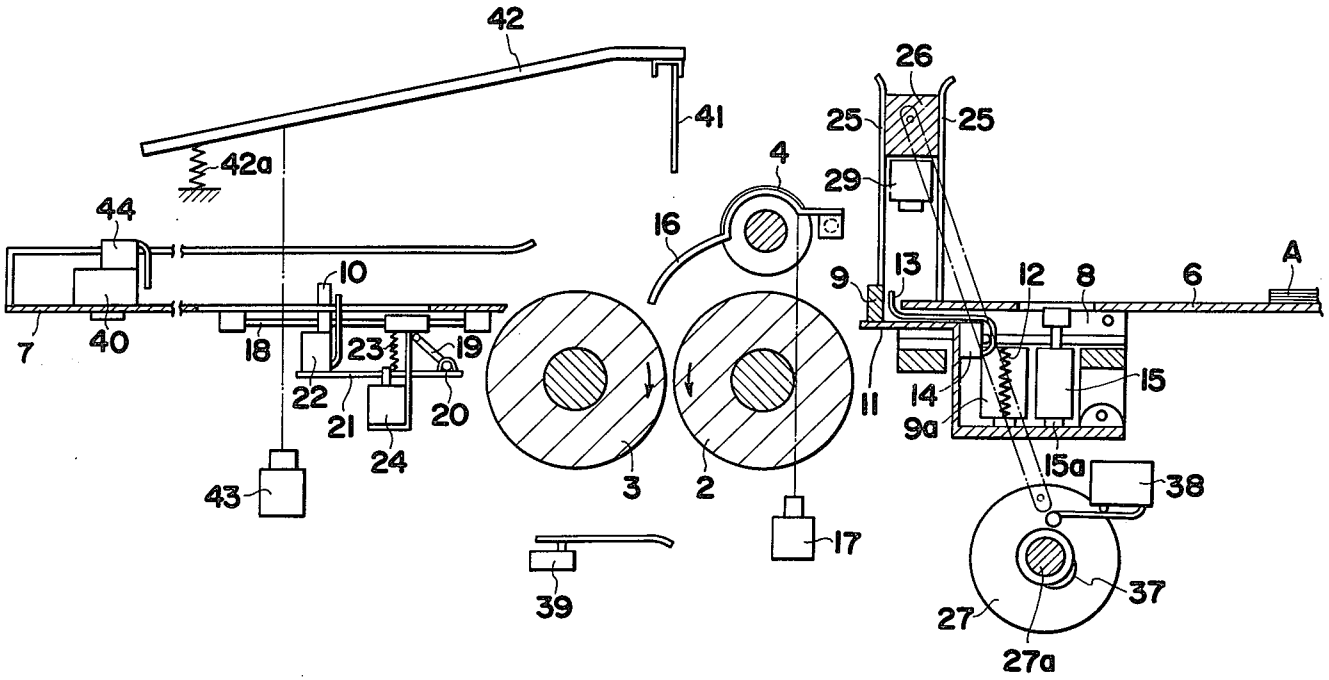
FIG. 2 is a longitudinally sectional view on an enlarged scale of the paper stack binding and folding device of FIG. 1.
Figure 4:
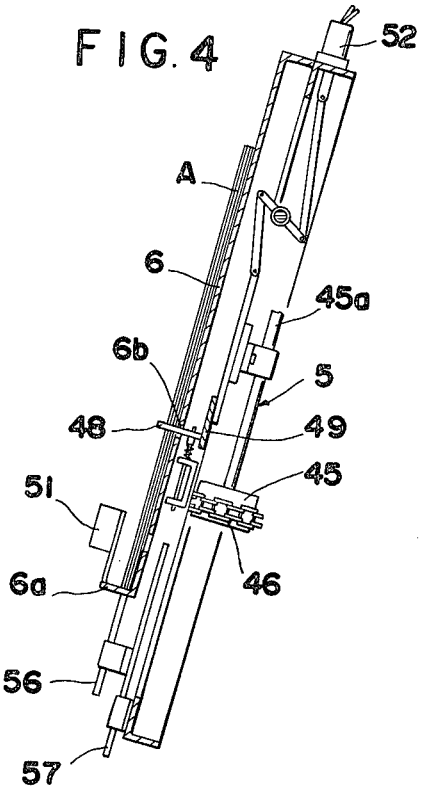
FIG. 4 is an end elevational view of the paper stack feed mechanism of said paper stack binding and folding device of FIG. 1.

A paper stack folding piece 41 is provided above the gap defined between the rolls 2, 3 for movement between the folding position in which the folding piece enters the gap and the inoperative position in which the folding piece is disposed above the gap as shown in FIG. 2. The folding piece 41 is secured to one end of an arm 42 which is pivoted at the other end to the machine frame 1 and normally urged upwardly by means of a spring 42*a* suitably secured to the machine frame 1. The arm 42 is adapted to be urged downwardly by a solenoid 43 against the force of the spring 42*a*. The solenoid 43 is adapted to be energized by a limit switch 44 having the operation piece (not shown) projecting in a position downstream of the stops 10 in the feed direction of the paper stack A and the limit switch 44 is adapted to be closed when the paper stack A abuts the stop 40 and opened when the paper stack A is pushed into the gap between the rolls 2, 3 by the downwardly moving folding piece 41 and separated from the stop 40 to thereby deenergize the solenoid 43.

The above-mentioned paper stack feed mechanism 5 comprises a pair of spaced sprockets 45, 45 rotatably mounted on the undersurface of the paper stack feed table 6, an endless chain 46 trained over the sprockets 45, 45 and a pawl 49 pivotally secured to the chain 46 by means of a pin 47. The pawl 48 integrally includes a paper stack abutment 48*a* and a cam face 48*b* which are disposed at right angles to each other. When the cam face 48*a* engages a slide plate 49 advanced into the chain 46 adjacent to the inner side of the advancing or lower run of the chain 46, the paper stack abutment 48*a* projects through the slit 6*b* in the paper stack feed table 6 to engage the trailing edge of the paper stack A to push the paper stack as the chain 46 rotates about the sprockets 45, 45.

The chain 46 is rotated from a motor 50 through the shafts 45*a* of the sprockets 45 and the rotation of the motor 50 is intermittently imparted to the sprocket shafts 45*a* through an electromagnetic switch 45*b*.

The slide plate 49 is adapted to be moved downwardly into the chain 46 by the energization of a solenoid 52 against the force of springs 49*a* and returns to the upper position under the force of the springs when the solenoid is deenergized.

The electromagnetic clutch 45*b* is actuated by a signal from a first photoelectric switch 51 which is mounted on the paper stack ruler 6*a* mounted on the paper stack feed table 6 adjacent to the lower edge thereof and actuated when the paper stack A is placed on the paper stack feed table 6. The electromagnetic switch 45*b* is deenergized and held in the deenergized condition for a predetermined time period after the paper stack A had passed the first photoelectric switch 51. The electromagnetic clutch 45*b* has a brake (not shown) therein to be operated thereby.

After the predetermined time period elapsed, the electromagnetic clutch 45*b* is again energized by a signal from the limit switch 38 which is actuated at the termination of the binding operation by the binding mechanism and then deenergized when the holding circuit associated with the switch 39 is turned off.

The solenoid 52 is adapted to normally hold the slide plate 49 in the upper position when the second photoelectric switch 53 is on.

In the paper stack binding and folding device of the present invention as described hereinabove, when the paper stack A is placed on the paper stack feed table 6, the paper stack feed mechanism 5 is actuated to feed the paper stack A toward and onto the rolls 2, 3.

In the operation of the paper stack binding and folding device, when the stops 9 are in the extended position, the paper stack A abuts against the extended stops 9 as the paper stack A is fed whereupon the feed mechanism ceases to operate and at the same time, the binding mechanism is actuated for performing a cycle of binding operation at the leading edge of the paper stack A. Substantially simultaneously with the termination of the binding operation, the stops 9 are retracted from the extended position and held in the retracted position and the feed mechanism is actuated again to feed the paper stack A from the rolls 2, 3.

When the paper stack A is desired to be bound in the center thereof, the stops 9 are held in the retracted position and the stops 10 are extended and the paper stack A is then fed over the rolls 2, 3 onto the paper stack stop position control table 7 until the leading edge of the paper stack A abuts against the stops 10 whereupon the paper stack binding mechanism is actuated to bind the paper stack A in the center thereof. After the binding operation in the center of the paper stack A has completed, the stops 10 are retracted from the extended position to the retracted position and the bound paper stack is further fed until the leading edge of the paper stack A abuts against the stop 40 whereupon the arm 42 is pivoted in the clockwise direction to lower the folding piece 41 into the gap between the rolls 2, 3. The lowering folding piece 41 pushes the center of the paper stack A into the gap until the paper stack emerges from the bottom of the gap whereby the paper stack is folded in the center thereof. As the folded paper stack A emerges from the gap, the folded paper stack actuates the switch 39 which in turn acts to release the stops 9, 10 from their retracted position.

The above-mentioned rulers 6*a*, 7*a* are mounted on the paper stack feed table 6 and the paper stack position control table 7, adjacent to the lower edges thereof respectively for movement upwardly and downwardly in parallel relationship to each other and when the solenoid 54 is energized, the rulers 6*a*, 7*a* are moved upwardly by a predetermined distance.

The rulers 6*a*, 7*a* are supported on a common vertically movable frame member 55 by means of stub shafts 56, 56 which slide straddling the paper stack feed table 6 and paper stack stop position control table 7 so that the position of the rulers 6*a*, 7*a* on the tables 6, 7 can be adjusted. The vertically movable frame member 55 movably mounted on the machine frame 1 further has a pair of spaced and parallel vertically movable slide shafts 57, 57 and the slide shafts are connected together by means of a connector rod 57*a* to which the plunger 54*a* of the above-mentioned solenoid 54 is connected.

The solenoid 54 is energized per every other rotation of the release switch 39 positioned below the rolls 2, 3.

Thus, the position of the rulers *6a, 7a* can be adjusted for accommodating paper stacks having different heights and/or dimensions so that proper folding and binding operations can be performed on such paper stacks.

With the above-mentioned construction and arrangement of the components of the paper stack folding and binding device of the present invention, the device can selectively perform edge binding and center binding folding operations as desired. Especially, the device can efficiently bind books having relatively small numbers of pages.

Furthermore, according to the present invention, since the machine frame having the paper stack feed and stop position control tables thereon is disposed at an angle with respect to the horizon with the upper edge positioned rearwardly of the lower edge and the paper stack is bound at the leading end or bound and folding in the center as the paper stack is fed from one end toward the other end of the device, the device occupies a relatively small space for installation of the device. And since the paper stack A is fed on the feed table and stop position control table with the lower edge in abutment with the rulers *6a, 7a,* the sheets of paper in the paper stack are vertically aligned with each other by the gravity of the sheets of paper. Furthermore, the sheets of paper in the paper stack are also aligned with each other both at the front and rear edges because the paper stack is pushed at the rear edge by the pawl of the paper stack feed mechanism whereby the operator or operators are not required to provide paper stacks in which the sheets of paper have been previously aligned with each other resulting in simple and smooth binding and floding operations.

While only one embodiment of the invention has been shown and described in detail, it will be understood that the same is for illustration purpose only and not to be taken as a definition of the invention, reference being had for this purpose to the appended claims.

I claim:

1. In a paper stack binding and folding device comprising a paper stack feed table inclined so as to dispose the upper edge rearwardly of the lower edge of said table and having a paper abutment ruler at said lower edge, said table further having a horizontal slit in the center of the table;

a paper stack feed mechanism mounted on said table and having a paper stack feed pawl adapted to extend above said table and retract below the table through said slit for feeding paper stacks in a feed direction toward a leading end of said feed table;

a stapling mechanism positioned at the leading end of said table and including stapler guns to eject staples to a paper stack and a cauking member for cauking free ends of said staples ejected from said stapler guns;

a binding position control stop means positioned adjacent and downstream of said stapling mechanism in the feed direction of said paper stack for holding said paper stack fed from said feed table in a predetermined binding position;

a paper stack folding mechanism positioned downstream of said stop means in the feed direction of said paper stack and having a pair of parallel and spaced folding rolls to define a gap located below the plane of said feed table therebetween and a paper stack folding piece positioned above said gap to push said bound paper stack into said gap to thereby fold the bound paper stack; and a paper stack folding position control stop means positioned downstream of said paper stack folding mechanism in the feed direction of said paper stack for holding said bound paper stack in a predetermined folding position, characterized by said paper stack feed table inclines at an angle over 60° with respect to the horizon, a paper stack folding position control table disposed in substantially the same inclined plane as said paper stack feed table, said paper stack binding and folding position control stop means are disposed in succession on said paper stack folding position control table, said stapling mechanism is positioned at and extends from the leading end of said feed table and said pair of folding rolls are positioned between and inclined at the same angle as the feed and folding position control table, whereby said paper stack is bound when the paper stack is positioned over the folding rolls and held in position by said binding position control stop means and after the binding operation the bound paper stack is pushed into said gap between the folding rolls to be folded while being held in position by said folding position control stop means.

2. The paper stack binding and folding device as set forth in claim 1, in which the position of said paper abutment ruler on the paper stack feed table is adjustable for accommodating paper stacks of different dimensions.

3. The paper stack binding and folding device as set forth in claim 1, in which said stapling mechanism includes a staple paying-out section extending above said paper stack feed table and a presser rod movably received in said staple paying-out section to push a staple fed from said stapler mechanism into said paper stack.

4. The paper stack binding and folding device as set forth in claim 1, in which said binding position control stop means includes a first stop positioned upstream of said folding rolls in a position adjacent said stapling mechanism for binding one edge of said paper stack and a second adjustable stop positioned downstream of said folding rolls for binding the center of the paper stack.

5. The paper stack binding and folding device as set forth in claim 1, in which said paper abutment ruler on the paper stack feed table is moved upwardly and downwardly each time said paper stack has been fed to said folding rolls.

* * * * *